US009448051B2

(12) United States Patent
Morrison et al.

(10) Patent No.: US 9,448,051 B2
(45) Date of Patent: Sep. 20, 2016

(54) DETONATOR INTERRUPTER FOR WELL TOOLS

(71) Applicant: Owen Oil Tools LP, Houston, TX (US)

(72) Inventors: Ian Morrison, Grandbury, TX (US); Lyle W. Andrich, Grandview, TX (US); Bradley Vass, Fort Worth, TX (US); Timothy E. LaGrange, Rainbow, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 0 days.

(21) Appl. No.: 14/621,018

(22) Filed: Feb. 12, 2015

(65) Prior Publication Data

US 2015/0226532 A1 Aug. 13, 2015

Related U.S. Application Data

(60) Provisional application No. 61/938,939, filed on Feb. 12, 2014.

(51) Int. Cl.
*F42D 5/04* (2006.01)

(52) U.S. Cl.
CPC ..... *F42D 5/04* (2013.01)

(58) Field of Classification Search
CPC ..... F42C 15/00; F42C 15/28; F42C 15/285; F42C 15/32; F42C 15/33; F42C 15/36
See application file for complete search history.

(56) References Cited

U.S. PATENT DOCUMENTS 2,118,277 A * 5/1938 Thoma ..... A43B 13/42 106/164.1
2,453,151 A * 11/1948 Miller, Jr. ..... F42C 15/36 102/222
2,725,821 A * 12/1955 Coleman ..... F42D 1/05 102/202.8
3,311,178 A * 3/1967 McElheny ..... E21B 43/1195 166/63
3,594,750 A * 7/1971 Mueller ..... G01K 11/06 116/105
3,888,182 A * 6/1975 Breed ..... F42C 9/06 102/272
H000464 H * 5/1988 Lee ..... C06C 9/00 102/364
4,762,067 A * 8/1988 Barker ..... E21B 43/1185 102/202.14
5,052,489 A * 10/1991 Carisella ..... F42D 1/04 166/297
5,070,788 A * 12/1991 Carisella ..... E21B 43/116 102/202.1

(Continued)

OTHER PUBLICATIONS

PCT/US2015/015659—International Search Report dated Feb. 12, 2015.

*Primary Examiner* — Bret Hayes
*Assistant Examiner* — Derrick Morgan
(74) *Attorney, Agent, or Firm* — Mossman, Kumar & Tyler PC

(57) ABSTRACT

An interrupter for use with a wellbore tool may include a housing having an interior and a fusible body disposed in the housing interior. The fusible body may be solid below a specified temperature and liquid above the specified temperature. The fusible body communicates a first high-order detonation to a detonator only when liquid. The communicated the first high-order detonation is at a magnitude sufficient to cause the detonator to produce a second high-order detonation.

16 Claims, 2 Drawing Sheets

(56) References Cited

U.S. PATENT DOCUMENTS 5,115,865 A * 5/1992 Carisella ..... F42D 1/04 166/297
5,159,145 A * 10/1992 Carisella ..... F42D 1/04 102/222
5,159,146 A * 10/1992 Carisella ..... F42D 1/04 102/222
5,197,671 A * 3/1993 Wass ..... F16K 17/383 137/72
5,213,128 A * 5/1993 Baird ..... F16K 17/16 137/68.23
5,256,370 A * 10/1993 Slattery ..... B23K 35/262 219/146.22
5,365,850 A * 11/1994 Persson ..... F42C 1/02 102/272
5,511,576 A * 4/1996 Borland ..... F16K 17/383 137/72
6,382,234 B1 * 5/2002 Birckhead ..... E21B 34/066 137/72
8,250,981 B1 * 8/2012 Gotzmer ..... F24B 1/00 102/314
8,322,426 B2 * 12/2012 Wright ..... E21B 34/063 166/317
8,397,800 B2 * 3/2013 Rodgers ..... E21B 17/07 166/178
2004/0107856 A1 * 6/2004 Hennings ..... F42B 3/127 102/202.7
2004/0244990 A1 * 12/2004 Herr ..... E21B 43/16 166/370
2006/0268645 A1 * 11/2006 Graf ..... H01H 37/761 365/225.7
2010/0073120 A1 * 3/2010 Knab ..... H01H 37/761 337/416
2012/0061109 A1 * 3/2012 Pavesi ..... A62C 17/00 169/46
2012/0204750 A1 * 8/2012 Sullivan ..... F42B 39/20 102/430
2014/0124215 A1 * 5/2014 Duphorne ..... E21B 33/12 166/376
2015/0000927 A1 * 1/2015 Madell ..... E21B 34/063 166/373
2015/0292850 A1 * 10/2015 Davidson ..... F42D 1/043 102/206

* cited by examiner

DETONATOR INTERRUPTER FOR WELL TOOLS

CROSS REFERENCE TO RELATED APPLICATIONS

This application claims priority from U.S. Provisional Application Ser. No. 61/938,939 filed on Feb. 12, 2014, the entire disclosure of which is incorporated herein by reference in its entirety.

TECHNICAL FIELD

The present disclosure relates to devices and methods for preventing an unintended activation of one or more downhole tools. More particularly, the present disclosure is in the field of control devices and methods for selectively interrupting an explosive train used to fire a gun.

BACKGROUND

One of the activities associated with the completion of an oil or gas well is the perforation of a well casing. During this procedure, perforations, such as passages or holes, are formed in the casing of the well to enable fluid communication between the well bore and the hydrocarbon producing formation that is intersected by the well. These perforations are usually made with a perforating gun loaded with shaped charges. The gun is lowered into the wellbore on electric wireline, slickline or coiled tubing, or other means until it is adjacent the hydrocarbon producing formation. Thereafter, a surface signal actuates a firing head associated with the perforating gun, which then detonates the shaped charges. Projectiles or jets formed by the explosion of the shaped charges penetrate the casing to thereby allow formation fluids to flow from the formation through the perforations and into the production string for flowing to the surface.

Many oil well tools incorporate a high-order detonation as part of their operation. It is desirable to ensure that such high-order detonations do not unintentionally activate the oil well tools at the surface or at an undesirable location in the wellbore. The present disclosure relates to methods and devices for preventing unintended detonation of perforating guns and other wellbore devices that use high-order detonations.

SUMMARY

In aspects, the present disclosure provides an interrupter for use with a wellbore tool. The wellbore tool may use a first detonator associated with a firing system and a second detonator associated with an adjacent tool. The first detonator produces a first high-order detonation and the second detonator produces a second high-order detonation. The interrupter may include a housing having an interior and a fusible body disposed in the housing interior. The fusible body may be solid below a specified temperature and liquid above the specified temperature. The fusible body communicates the first high-order detonation to the second detonator only when liquid. The communicated first high-order detonation is at a magnitude sufficient to cause the second detonator to produce the second high-order detonation.

It should be understood that examples of certain features of the disclosure have been summarized rather broadly in order that the detailed description thereof that follows may be better understood, and in order that the contributions to the art may be appreciated. There are, of course, additional features of the disclosure that will be described hereinafter and which will in some cases form the subject of the claims appended thereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION

Figure 1:
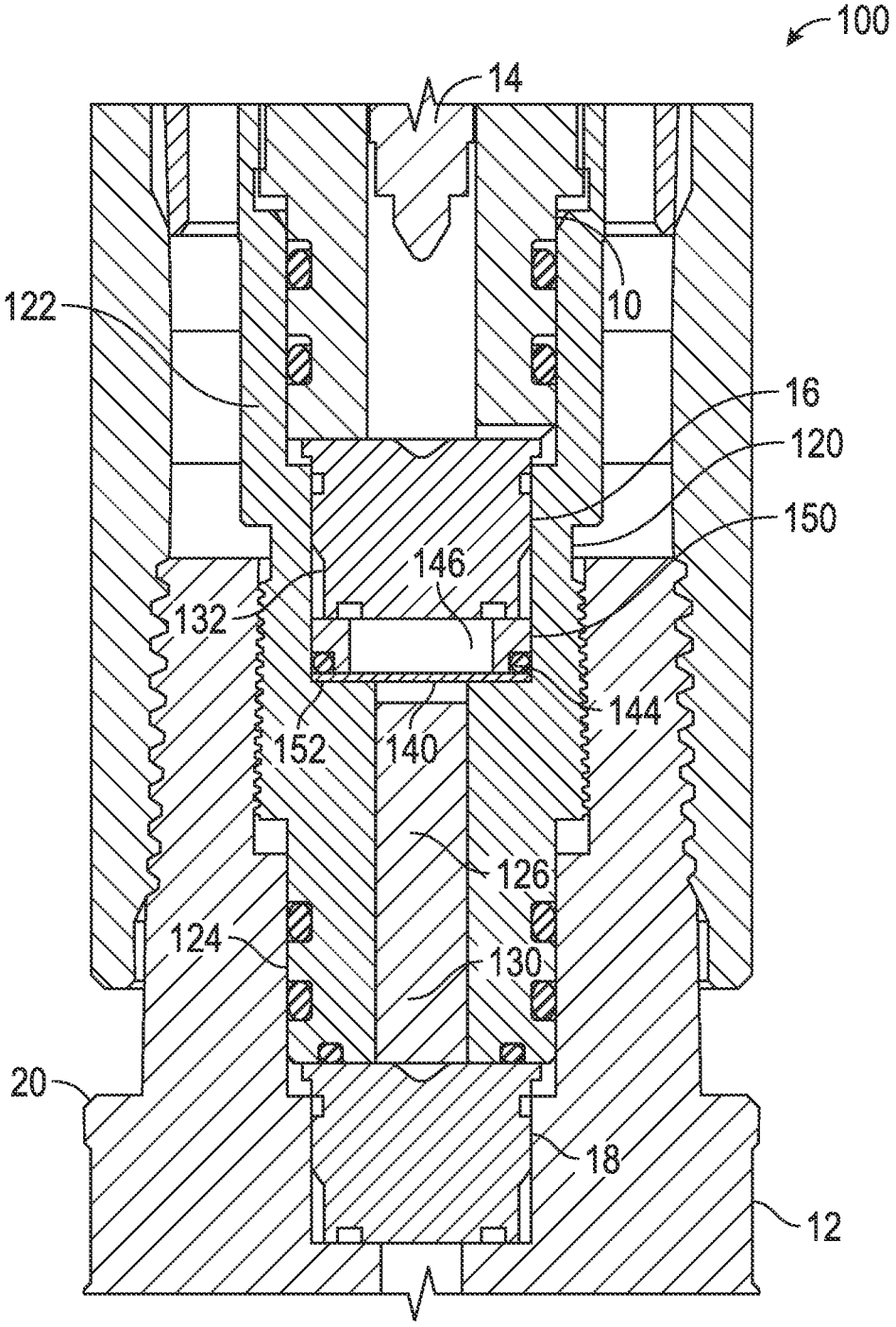
FIG. 1 schematically illustrates a side sectional view of a detonator interrupter according to one embodiment of the present disclosure.

The present disclosure relates to devices and methods for preventing an unintended activation of one or more downhole tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is schematically illustrated one embodiment of an interrupter 100 made in accordance with the present disclosure that allows a first high-order detonation to initiate a second high-order detonation only if one or more specified conditions exist. In one arrangement, upon receiving a firing signal from a firing system 10, the interrupter 100 activates an adjacent device 12, such as a perforating gun, only if a specified ambient condition exists. Illustrative firing systems 10 include, but are not limited to a firing head, time delay fuses, or any other devices that can generate a high-order detonation. As used herein, a high-order detonation is a detonation that produces high amplitude pressure waves (e.g., shock waves) and thermal energy. In the illustrated embodiment, the high-order detonation occurs when a firing pin 14 percussively impacts and detonates a detonator 16. Under prescribed situations, the interrupter 100 communicates the high-order detonation of the detonator 16, which may include pressure waves, such a shock waves, to a detonator 18 associated with the adjacent device 12. The detonator 18 generates a subsequent, or second, high-order detonation that activates the adjacent device 12, which may be a perforating, tubing cutter, or any other wellbore tool.

In embodiments, the interrupter 100 may be configured to be functionally reactive to an ambient temperature at the interrupter 100. By functionally reactive, it is meant that the interrupter 100 is non-functional and does not communicate the high-order detonation from the firing system 10 to the detonator 18 if the ambient temperature is below a specified value, but the interrupter 100 becomes functional and does communicate the high order detonation to the detonator 18 when the ambient temperature is at or above the specified value. In embodiments, the specified value is an expected ambient temperature in a wellbore (e.g., 160 degrees F.).

In one embodiment, the interrupter 100 includes a housing 120 and a fusible body 130. The housing 120 may be a tubular body that has an input end 122, an output end 124, an interior 126 for receiving the fusible body 130, and a cavity 132 in which the detonator 16 is positioned. The input end 122 may be adapted to connect with the firing system 10 using conventional connection methods such as threads. Similarly, the output end 124 may be adapted to mate with a housing 20 or sub associated with the adjacent device 12 with a threaded connection.

The fusible body 130 may be formed as a cylinder, pellet, rod, or any other suitable shape and be composed of one or more materials that are solid when at ambient surface temperatures (e.g., 120 degrees F. or less) and that melt when exposed to ambient wellbore temperatures (e.g., 160 degrees F. or greater).

In some embodiments, the fusible body 130 may revert from liquid state to a solid state when returned to a cooler environment. Generally speaking, the fusible body 130, when solid, is sufficiently rigid or non-deformable to block the shock wave generated by the detonator 16. In the liquid form, the fusible body 130 becomes sufficiently non-viscous or fluid to convey the shock wave generated by the detonator 16 to the output end 124. In one non-limiting embodiment, the fusible body 130 is formed at least partially of a fusible material. Illustrative, but not exhaustive fusible materials, include alloys containing bismuth, lead, tin cadmium and indium.

The interrupter 100 may include one or more features to confine the fusible body 130 within the housing 120. For instance, the interrupter 100 may include a frangible element 140 and a seal 144 that cooperate to isolate the interior 126 from the cavity 132 receiving the detonator 16. Thus, the frangible element 140 and the seal 144 can prevent the liquefied body 130 from leaking into the cavity 132. The frangible element 140 may be a rupture disk, plate, wafer, or other similar member that shatters or otherwise breaks when subjected to the high-order detonation of the detonator 16. The seal 144 may be a gasket, o-ring, or other suitable sealing element. In embodiments, a gap or space 146 may be maintained between the frangible element 140 and the detonator 16. The gap 146 may formed by using a sleeve 150 nested between the frangible element 140 and the detonator 16. In some embodiments, the detonator 16 may be threaded such that mating the detonator 16 within the housing 120 compresses the sleeve 150, the seal 144, and the frangible element 140 against a shoulder 152 formed in the interior 132.

One illustrative mode of use of the interrupter 100 will be discussed in connection with FIGS. 1 and 2. For clarity, the interrupter 100 will be discussed with reference to perforating guns. It should be appreciated, however, that the interrupter 100 is not limited to such use.

Figure 2:
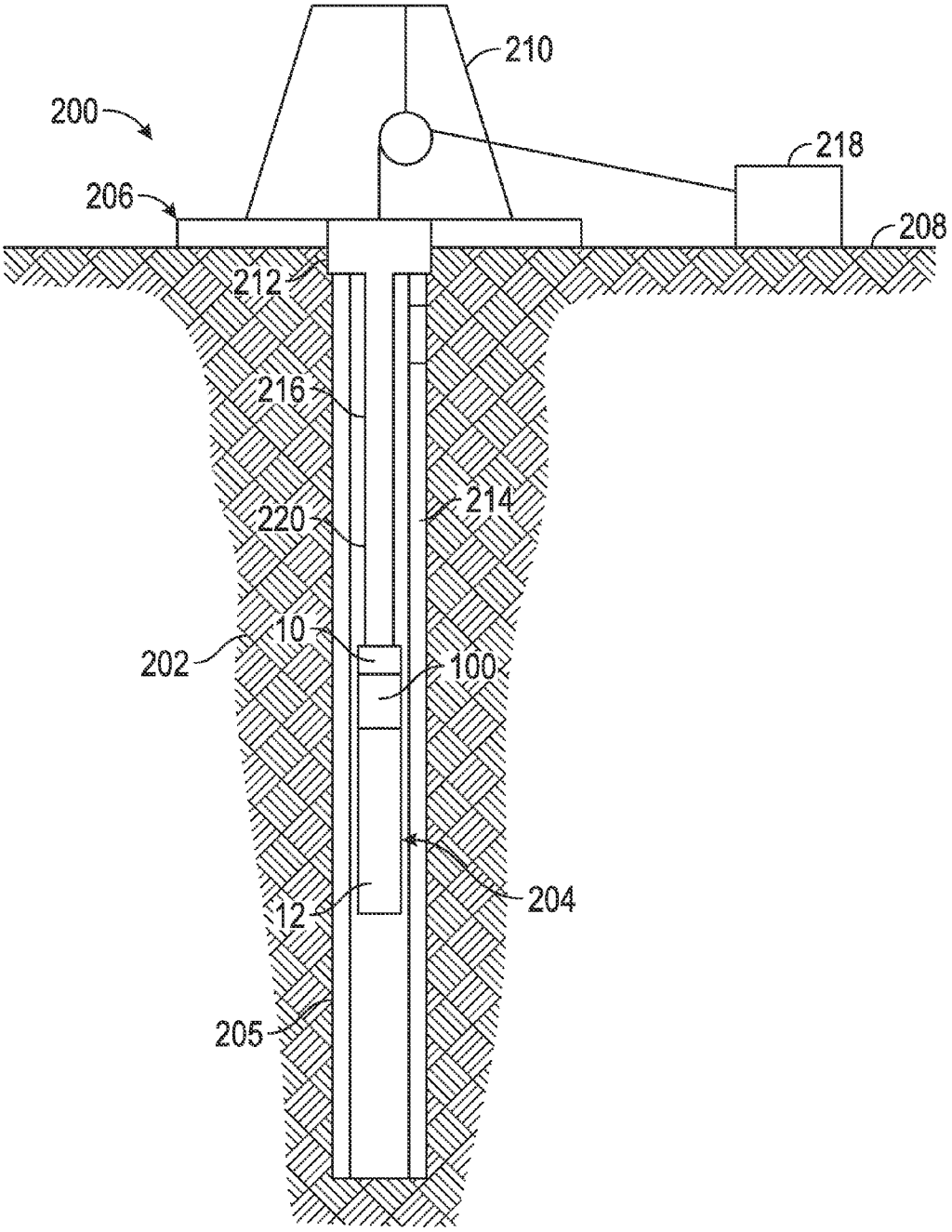
FIG. 2 schematically illustrates an elevation view of a surface facility adapted to perform one or more pre-defined tasks in a wellbore using one or more downhole tools.

Referring to FIG. 2, there is shown a well construction and/or hydrocarbon production facility 200 positioned over a subterranean formation of interest 202. An interrupter 100 made in accordance with the present disclosure in connection with a downhole tool 204 adapted to perform one or more predetermined downhole tasks in a well bore 205. While the wellbore 205 is shown as vertical, it should be understood that the wellbore 205 may include multiple sections having a complex geometry, e.g., one or more vertical sections, one or more deviated sections, one or more horizontal sections, etc. The facility 200 can include known equipment and structures such as a platform 206 at the earth's surface 208, a rig 210, a wellhead 212, and cased or uncased pipe/tubing 214. A work string 216 is suspended within the well bore 205 from the derrick 210. The work string 216 can include drill pipe, coiled tubing, wire line, slick line, or any other known conveyance means. The work string 216 can include telemetry lines or other signal/power transmission mediums that establish one-way or two-way telemetric communication from the surface to the downhole tool 204 connected to an end of the work string 216. For brevity, a telemetry system having a surface controller (e.g., a power source) 218 adapted to transmit electrical signals via a cable or signal transmission line 220 disposed in the work string 216 is shown.

In one mode of use, the interrupter 100 is inserted into tool 204 to prevent an unintended actuation of the tool 204; e.g., prevent actuation of the tool 204 at the surface or at an undesirable location in the wellbore 205. The tool 204 may have a firing system 10 and an adjacent device 12. As discussed above, the material(s) of the fusible body 130 of the interrupter 100 is/are selected to be solid at the surface and remain solid until a specified ambient temperature around the tool 204 has been reached. As long as the ambient temperature is below the specified temperature, the fusible body 130 is solid. Therefore, if the firing system 10 or other source detonates the detonator 16, the high-order detonation may burst the frangible element 104, but only partially melt the fusible body 130. The remaining solid portion of the fusible body 130 blocks the high-order detonation from being emitted from the housing 120 and detonating the detonator 18. Of course, some fraction of the high-order detonation may escape the housing 120, but that amount is insufficient to detonate the detonator 18.

As the tool 204 travels through the wellbore 205, the ambient temperature will gradually reach the specified ambient temperature. The fusible body 130 reacts to the elevated ambient temperature by melting and forming a liquid column that can transmit a shock wave. Thus, the interrupter 100 has become functional due to the elevated ambient temperature. The housing 120 remains a solid in order to contain the liquefied fusible body 130. It should be noted that there may be a period of time that the fusible body 130 is liquid before a firing signal is received. During this time, tool 204 may be conveyed through sections of the wellbore 205 that are non-vertical. That is, the wellbore 205, while shown as vertical, may have non-vertical sections and that some sections may be horizontal. In these situations, the frangible element 140 and the seal 144 confine the liquefied body 130 within the interior 126. Thus, if for some reason the tool 204 is extracted from the wellbore 205 without actuating the tool 204, the liquefied body 120 does not leak into and damage the remainder of the interrupter 100.

After the target depth has been reached, the firing system 10 may be actuated to transmit the firing signal to the detonator 16. For example, the firing signal may be the firing pin 14 that percussively impacts the detonator 16. In response, the detonator 16 detonates and produces a first high-order detonation. The high-order detonation shatters the frangible element 140. Thereafter, the fusible body 130, which is a liquid column, communicates the high-order detonation (e.g., shock waves) to the detonator 18 positioned at the output end 124. This high-order detonation detonates the detonator 18, which produces a second high-order detonation that may be used to activate the adjacent device 12.

From the above, it should be noted that the interrupter 100 has at least two distinct functions. One function is to adequately suppress a primary high-order detonation to prevent a second high-order detonation when an ambient temperature is below a predetermined or specified temperature. Another function is to adequately communicate the primary high-order detonation to cause a second high-order detonation when an ambient temperature is at least at a predetermined or specified temperature.

It should be noted understood that the melting point of the fusible body 130 does not necessarily have to be at the expected ambient wellbore temperature. For example, the expected ambient temperature at the target depth, i.e., the depth at which the device 12 is intended to be activated, may be 200 degrees F. The predetermined melting point may be selected to be a temperature somewhere between the expected surface temperature and the ambient target depth temperature; e.g., 150 or 160 degrees F. In aspects, a fusible body 130 is a body that liquefies at a temperatures of: 400 degrees F. or less, 360 degrees F. or less, 300 degrees F. or less, 250 degrees or less, 200 degrees F. or less, or 150 degrees F. or less.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. An interrupter for a wellbore tool having a first detonator associated with a firing system and a second detonator associated with an adjacent tool; wherein the first detonator produces a first high-order detonation and the second detonator produces a second high-order detonation, the interrupter comprising:

a cylindrical housing having:

an input end configured to connect with the firing system, an output end directing the first high-order detonation to the second detonator, a cavity in which the first detonator is positioned, and an interior in communication with the cavity;

a fusible body disposed in the interior, the fusible body having a liquid state wherein the fusible body transfers the first high-order detonation to the second detonator; and wherein the fusible body is between the first detonator and the second detonator while in the liquid state.

2. The interrupter of claim 1 wherein the fusible body is in the liquid state at a temperature below 400 degrees F.

3. The interrupter of claim 2 wherein the fusible body has a solid state when an ambient temperature is below 120 degrees F.

4. The interrupter of claim 1, wherein the fusible body is an alloy that includes at least one of: (i) bismuth, (ii) lead, (iii) tin, (iv) cadmium, and (v) indium.

5. The interrupter of claim 1, further comprising a frangible element and a seal positioned inside the housing and between the first detonator and the fusible body, the frangible element and the seal cooperating to isolate the interior from the cavity.

6. The interrupter of claim 5, wherein the frangible element is configured to break when subjected to the first high order detonation.

7. The interrupter of claim 6, further comprising a sleeve disposed between the frangible element and the first detonator, the sleeve forming a gap between the frangible element and the first detonator.

8. An interrupter for a wellbore tool having a first detonator associated with a firing system and a second detonator associated with an adjacent tool, wherein the first detonator produces a first high-order detonation and the second detonator produces a second high-order detonation, the interrupter comprising:

housing having an interior;

a fusible body disposed in the housing interior, the fusible body being solid below a specified temperature and being liquid above the specified temperature, wherein the fusible body communicates the first high-order detonation to the second detonator only when liquid, the communicated first high-order detonation being at a magnitude sufficient to cause the second detonator to produce the second high-order detonation; and wherein the fusible body, while in a liquid state, is configured to convey, via the housing interior, a shock wave generated by the first detonator to the second detonator.

9. The interrupter of claim 8, further comprising a frangible element and a seal disposed in the housing, the frangible element and the seal element cooperating to contain the liquid fusible body in a sealed section of the interior, and wherein the frangible element is configured to break when subjected to the first high-order detonation.

10. The interrupter of claim 9, further comprising a spacer interposed between the frangible element and the first detonator.

11. The interrupter of claim 9, wherein the specified temperature is between an ambient surface temperature and an ambient temperature in a wellbore in which the wellbore tool is disposed.

12. An apparatus for performing an operation in a wellbore, comprising:

a carrier;

a firing system conveyed by the carrier, the firing system including a first detonator;

a well tool positioned next to the firing system and conveyed by the carrier, the well tool having a second detonator, wherein the first detonator produces a first high-order detonation that detonates the second detonator; and an interrupter connecting the firing system with the well tool, the interrupter comprising:

a cylindrical housing having:

an input end configured to connect with the firing system, an output end directing the first high-order detonation to the second detonator, a cavity in which the first detonator is positioned, and an interior in communication with the cavity;

a fusible body disposed in the housing interior, the fusible body having a liquid state wherein the fusible body transfers the first high-order detonation to the second detonator; and wherein the fusible body, while in a liquid state, is configured to convey, via the cavity, a shock wave generated by the first detonator to the output end.

13. The apparatus of claim 12, wherein the cavity is positioned to receive the first-high order detonation from the first detonator.

14. The apparatus of claim 12, wherein the fusible body is between the first detonator and the second detonator while in the liquid state.

15. The interrupter of claim 1, wherein the cavity is positioned to receive the first-high order detonation from the first detonator.

16. The interrupter of claim 1, wherein the fusible body, while in a liquid state, is configured to convey via the cavity a shock wave generated by the first detonator to the output end.

* * * * *